US009194098B2

(12) United States Patent
Shea et al.

(10) Patent No.: US 9,194,098 B2
(45) Date of Patent: Nov. 24, 2015

(54) PIVOTING THUMB STOP SYSTEM AND METHOD

(71) Applicant: Caterpillar Inc., Peoria, IL (US)

(72) Inventors: Ryan Patrick Shea, Manhattan, KS (US); Aaron Dean Kovar, Topeka, KS (US)

(73) Assignee: Caterpillar Inc., Peoria, IL (US)

( * ) Notice: Subject to any disclaimer, the term of this patent is extended or adjusted under 35 U.S.C. 154(b) by 332 days.

(21) Appl. No.: 13/650,038

(22) Filed: Oct. 11, 2012

(65) Prior Publication Data

US 2014/0101976 A1 Apr. 17, 2014

(51) Int. Cl.
*E02F 3/40* (2006.01)
*E02F 9/00* (2006.01)

(52) U.S. Cl.
CPC ..... *E02F 3/404* (2013.01); *E02F 9/006* (2013.01)

(58) Field of Classification Search
CPC ..... E02F 3/404; E02F 3/413; E02F 3/4135; E02F 9/006
USPC ..... 37/195, 403–410, 468
See application file for complete search history.

(56) References Cited

U.S. PATENT DOCUMENTS

| | | | | |
|---|---|---|---|---|
| 3,026,368 | A * | 3/1962 | Lindsey | 174/169 |
| 3,243,905 | A * | 4/1966 | Ulrich | 37/406 |
| 3,336,684 | A * | 8/1967 | Ulrich | 37/406 |
| 5,163,699 | A | 11/1992 | Specktor | |
| 6,467,202 | B1 * | 10/2002 | Brown, Jr. | 37/445 |
| 6,503,039 | B2 | 1/2003 | Ward | |
| 7,331,589 | B2 | 2/2008 | Ingalls et al. | |
| 7,818,901 | B2 | 10/2010 | Zeno et al. | |
| 2004/0045770 | A1 * | 3/2004 | Duan | 182/213 |
| 2006/0201746 | A1 * | 9/2006 | Jackson | 182/204 |
| 2006/0278474 | A1 * | 12/2006 | Cumbie | 182/207 |
| 2007/0284190 | A1 * | 12/2007 | Chady | 182/107 |
| 2009/0178886 | A1 * | 7/2009 | Joyner | 182/206 |
| 2011/0017548 | A1 * | 1/2011 | Green et al. | 182/108 |
| 2011/0168492 | A1 * | 7/2011 | Johnson | 182/107 |
| 2011/0226551 | A1 * | 9/2011 | Iverson et al. | 182/107 |
| 2012/0048647 | A1 * | 3/2012 | Green et al. | 182/111 |

* cited by examiner

*Primary Examiner* — Jamie L McGowan
(74) *Attorney, Agent, or Firm* — Baker & Hostetler LLP

(57) ABSTRACT

A stop system may include: a first member; a second member movable with respect to the first member, the first and second members being different parts of a common machine; a body including a boss defining a hole; a base plate at least one of: attached to and part of, the body on the side of the body opposite of the boss, the body and base plate forming a shoe; and a fastener extending through the hole in the boss thereby pivotally attaching the body to one of the first and second member. A method of providing a stop for stopping a thumb against a stick is also described.

13 Claims, 11 Drawing Sheets

PIVOTING THUMB STOP SYSTEM AND METHOD

TECHNICAL FIELD

The present disclosure relates generally to a stop system and a mechanism for adjusting the stop system. More particularly, the present disclosure relates to a stop system for stopping a thumb against a stick on a mechanical arm and an adjusting system for adjusting features of the stop system.

BACKGROUND

Excavating machines often use an arm which may include a boom having a stick pivotally connected to the boom. A bucket is pivotally connected to the stick. In some instances, a thumb may also be connected to the stick which can open or close over the bucket. When the thumb is in its extreme open position, it may contact or reside against the stick. Sometimes the thumb may contact the stick with more force than is desired. For example, more force than desired can be caused by force resulting from the weight of the thumb cylinder, the stick, the boom, boom cylinder, and/or the stick cylinder. In order to reduce the likelihood of damage between the thumb and/or stick, a stop system may be instituted to stop or butt the thumb against the stick.

Some stop systems may use a linkage. Such a system is described in U.S. Pat. No. 7,818,901. Other systems may provide structure for the thumb to butt against on the stick. Examples of these type of systems are also described in this patent in its discussion of the prior art. The use of a linkage as a stop system may require various links to transmit large forces and require complicated linkages. Other stop systems may result in large projections extending from the surface of the stick, which may interfere with operation of the excavating equipment.

It may be desirable to provide an adjusting system in order to adjust the stop system to be in a desired location. Due to manufacturing tolerances, flexing of parts due to wear and/or damage, and a variety of other reasons, the stop system may move out of a desired location after manufacturing of the machine. Thus, it may be desirable for the adjusting system by be adjusted after the machine has left the factory.

Some adjusting systems use a cam washer for providing an adjustment. An example of such a system is described in U.S. Pat. No. 5,163,699. The cam member includes a mechanism for detachably attaching the cam member to the nut or to the head of the bolt such that the cam member is rotatable by engagement of the nut and/or the bolt. When the cam member is rotated, the cam member works against a cam member bearing surface such that the bolt is moved sideways thereby providing adjustment.

SUMMARY

The present disclosure describes a stop system, an adjusting system for the stop system, a method for stopping, and a method for adjusting a stop system.

In the disclosure, a stop system is described. The stop system may include: a first member; a second member movable with respect to the first member, the first and second members being different parts of a common machine; a body including a boss defining a hole; a base plate at least one of: attached to and part of, the body on the side of the body opposite of the boss, the body and base plate forming a shoe; and a fastener extending through the hole in the boss thereby pivotally attaching the body to one of the first and second members.

In the disclosure, a method of providing a stop for stopping a thumb against a stick is described. The method may include installing a pivotable shoe on one of the thumb and stick.

In the disclosure, a stop system is described. The system includes: a first member; a second member movable with respect to the first member, the first and second members being different parts of a common machine; a pivoting means for abutting attached to one of the first and second members; and a contact surface located on the other of the first and second members than the pivoting means for abutting, the contact surface located such that when the first and second members are in contact with each other the pivoting means for abutting is contacting the contact surface.

In the disclosure, an adjusting system is described. The adjusting system includes: a slug defining an eccentric hole; and a locking structure defined by an outer circumference of the slug, the locking structure dimensioned and configured to lock the slug in a rotational orientation when the slug is placed in a hole having a corresponding locking feature, the locking structure configured to permit the slug to be placed in the corresponding hole in at least two different angular orientations and lock with the locking feature in the corresponding hole at each of the at least two different angular orientations.

In the disclosure, a method for adjusting stop shoes is also described. The method includes: rotating a slug to a desired angular orientation; inserting the slug into a hole; locking the slug to a particular angular orientation with locking structure attached to both of the slug and the hole; and securing a stop shoe to the slug.

In the disclosure, an adjusting system is described. The system may include: a means for defining an eccentric hole; a means for preventing the rotation of the means for defining an eccentric hole when the means for defining an eccentric hole is inserted into the means for preventing the rotation of the means for defining an eccentric hole; means for abutting pivotally attached to the means for defining an eccentric hole; and a fastener pivotally connecting the means for abutting to the means for defining an eccentric hole, the fastener extending through both the means for abutting and the eccentric hole.

DETAILED DESCRIPTION

Figure 1:
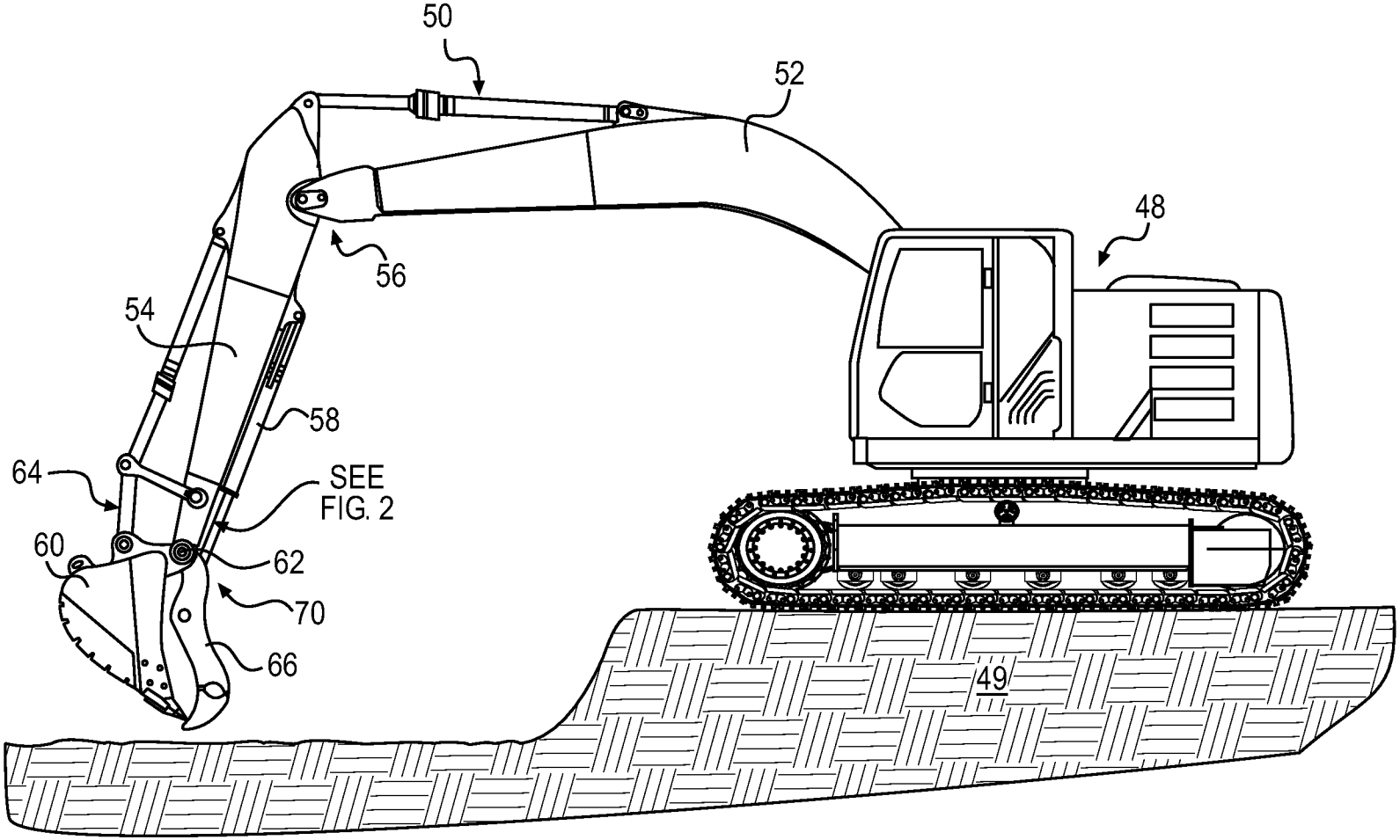
FIG. 1 is a side view of an excavating machine having an arm incorporating an apparatus described herein.

The apparatus and methods disclosed herein will now be described with reference to the drawing figures, in which like reference numerals refer to like parts throughout. The present disclosure describes several systems and methods for providing a thumb stop to stop a thumb that moves to cover a bucket against a stick that supports the thumb and bucket. The present disclosure further describes various systems and methods for adjusting the height of various thumb stop systems.

FIG. 1 illustrates a side view of an excavating machine 48 that excavates earth or other material 49. The excavating machine 48 includes an arm 50 that may be used in various pieces of excavating equipment and not just the example machine 48 shown. The arm 50 includes a boom 52 pivotally attached to a stick 54 via a pivot joint 56. The stick 54 may be terminated with a bucket 60. The bucket 60 is pivotally connected by pivot joint 62 to the stick 54. The bucket 60 may also include a linkage 64 which may be attached to a hydraulic cylinder which, is only partially shown to avoid overcrowding FIG. 1. The arm 50 may also be equipped with a thumb 66. The thumb 66 may be actuated by a hydraulic cylinder 58 attached to a linkage 70. The linkage 70 and other linkage that is associated with the hydraulic cylinder 58 is not completely shown to avoid overcrowding FIG. 1.

The thumb 66 may pivot about the pivot joint 62. The thumb 66 may move, close to or contact the bucket 60 to allow the arm 50 pickup various objects. Furthermore, the thumb 66 may be used as a cover for the bucket 60 to avoid or hinder material contained in the bucket 60 from falling out. When the thumb 66 is in a position distal from the bucket 60 similar to that shown in FIG. 1, the thumb 66 may be proximate to or even contact the stick 54. In order to reduce force concentration when the thumb 66 contacts the stick 54 in a hard manner as to potentially damage either the stick 54 or the thumb 66 a thumb stop system 73 may be implemented.

Figure 2:
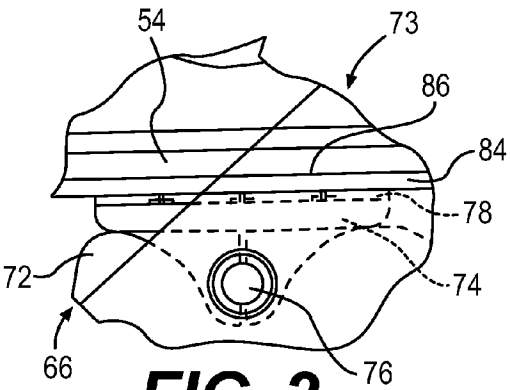
FIG. 2 is a partial enlarged side view of the arm at the place indicated in FIG. 1.

FIG. 2 is a partial, expanded side view of a thumb stop system 73 at the place indicated in FIG. 1. The thumb stop system 73 shown in FIG. 2 includes a stop shoe 74 attached to a rib 72 on the thumb 66. The stop shoe 74 includes a tread plate or 78 (sometimes referred to as a base plate) and is attached to the ribs 72 by fastener 76. The tread plate 78 is shown butted up against the pressure plate 84 on the underside 86 of the stick 54. The pressure plate 84 constitutes a contact surface for the stop shoes 74 to butt against. In embodiments where there is no pressure plate 84 the outer surface of the stick 54 is a contact surface. The dashed lines illustrate parts that are hidden from view due to the presence of the thumb 66.

Figure 3:
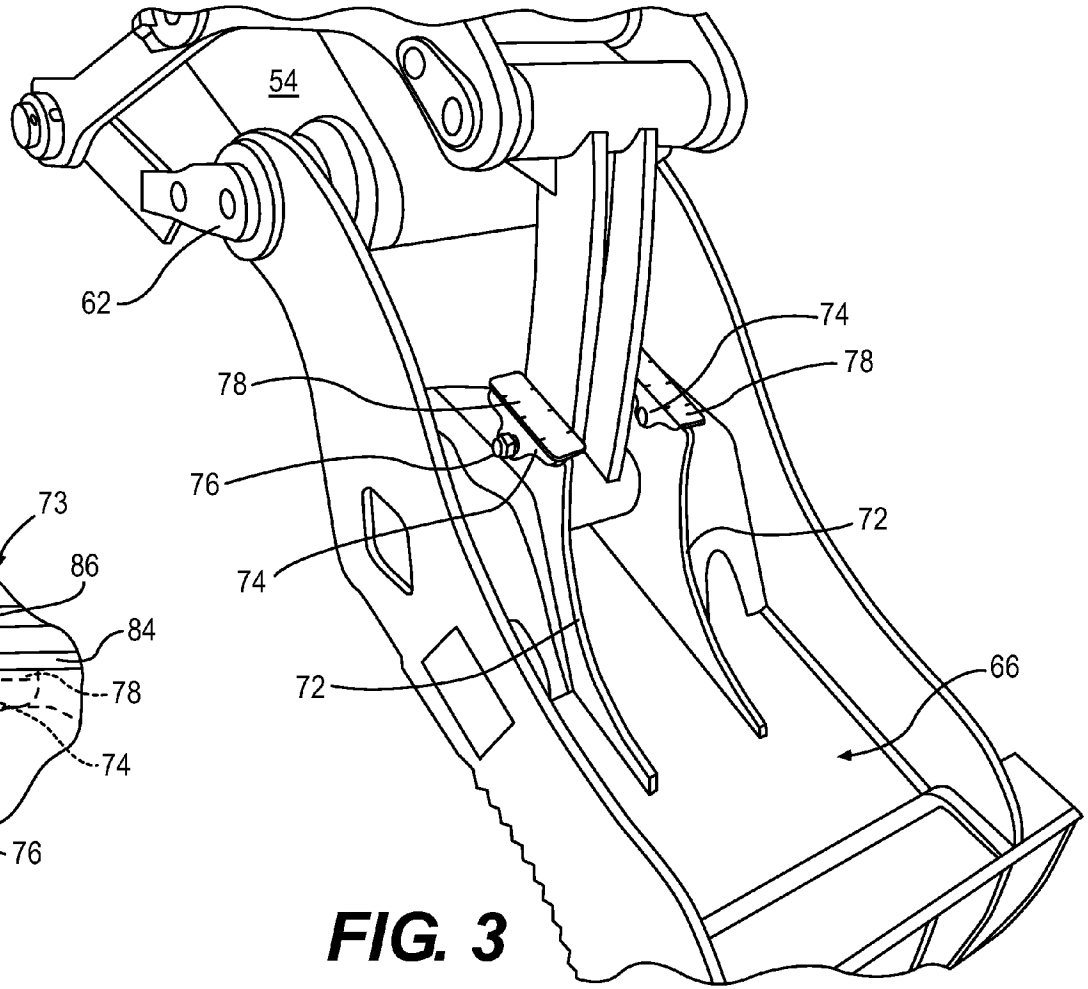
FIG. 3 is a partial isometric view of a stop system described herein.

FIG. 3 is a partial isometric view where the thumb 66 is pivoted about the pivot joint 62 away from the stick 54. The ribs 72 may be normally present on the thumb 66. The ribs 72 may be used to stiffen the thumb 66. However, in accordance with an apparatus disclosed herein, the rib 72 provides an additional function of providing a mounting place for the stop shoe 74. The stop shoe 74 is attached to the ribs 72 via a fastener 76. The tread plate 78 of the stop shoes 74 are also shown.

Figure 4:
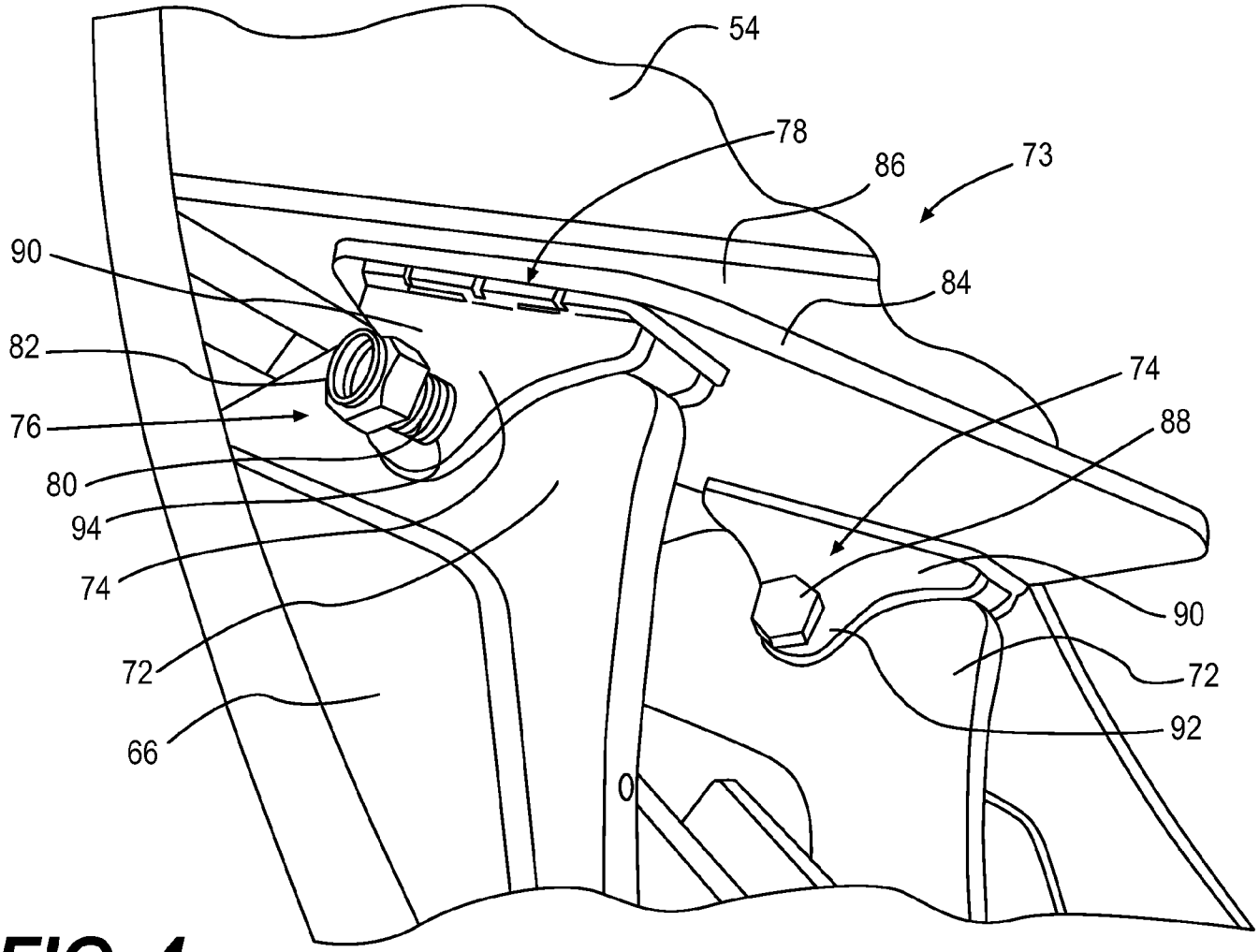
FIG. 4 is a partial isometric view of a stop system described herein.
Figure 8:
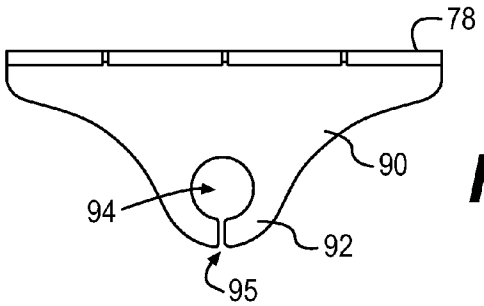
FIG. 8 is a side view of a stop shoe.
Figure 9:
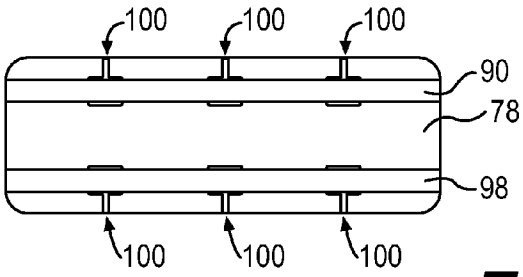
FIG. 9 is a bottom view of a stop shoe.

FIG. 4 is an enlarged isometric view showing the tread plate 78 of the stop shoe 74 pressed against the pressure plate 84. According to a stop system 73 described herein, the stop system 73 may include a stop shoe 74, a fastener 76 which include bolts 80 having bolt heads 88 and lock nuts 82. The stop shoe 74 includes a body portion 90. The body portion 90 has a boss 92 which may define a hole 94. It is through the hole 94 that the bolt 80 extends through along with a hole in the rib 72 in order to attached the stop shoe 74 to the rib 72.

FIGS. 5-9 respectively are isometric, end, top, side, and bottom views of a stop shoe 74 according to one embodiment. With reference to FIGS. 5-9, the stop shoe 74 includes bodies 90, 98 and a boss portion 92. Holes 94 extend through the boss portion 92 and it is through the holes 94 that the bolts 80 extend through including a hole in the rib 72 to attach stop shoe 74 to the rib 72. The hole 94 may have an opening 95. Other stop shoes 74 may not have an opening 95 but may be closed as shown in FIG. 11.

Figure 6:
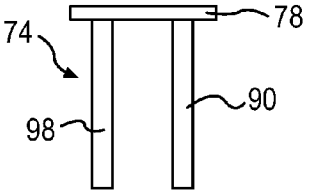
FIG. 6 is an end view of a stop shoe.
Figure 7:
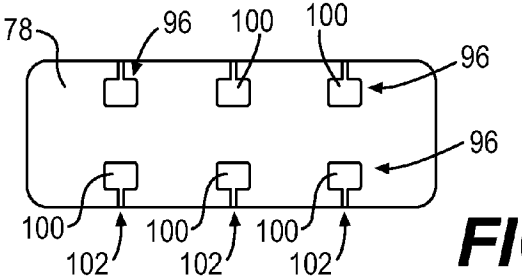
FIG. 7 is a top view of a stop shoe.

As seen in FIG. 6, the stop shoe 74 may include a second body 98 which may be constructed substantially the same as the first body 90. The two bodies 90, 98 may be connected via the tread plate 78. The tread plate 78 may include tread plate holes 96. The tread plate holes 96 may have openings 102. The bodies 90 and 98 may include protrusions 100 that extend at least partially into the holes 96 in the tread plate 78.

Figure 10:
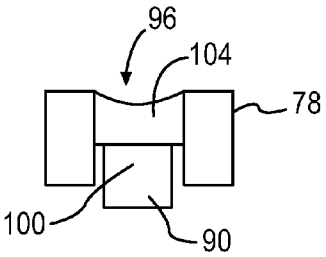
FIG. 10 is a partial cross-sectional view of a stop shoe.
Figure 5:
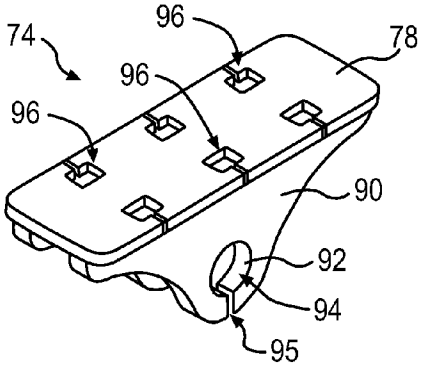
FIG. 5 is a isometric view of a stop shoe.

FIG. 10 is a partial cross-sectional view of the body 90 the tread plate 78 at a hole 96 in the tread plate 78. Some stop shoes 74 may be fabricated by welding the body 92 the tread plate 78 at the protrusions 100 in the holes 96. FIG. 10 shows weld material 104 in the hole 96 above the protrusion 100 of the body 90. Other stop shoes 74 may be fabricated in other manners where the bodies 90, 98, and the tread plate 78 are attached in other fashions.

Figure 11:
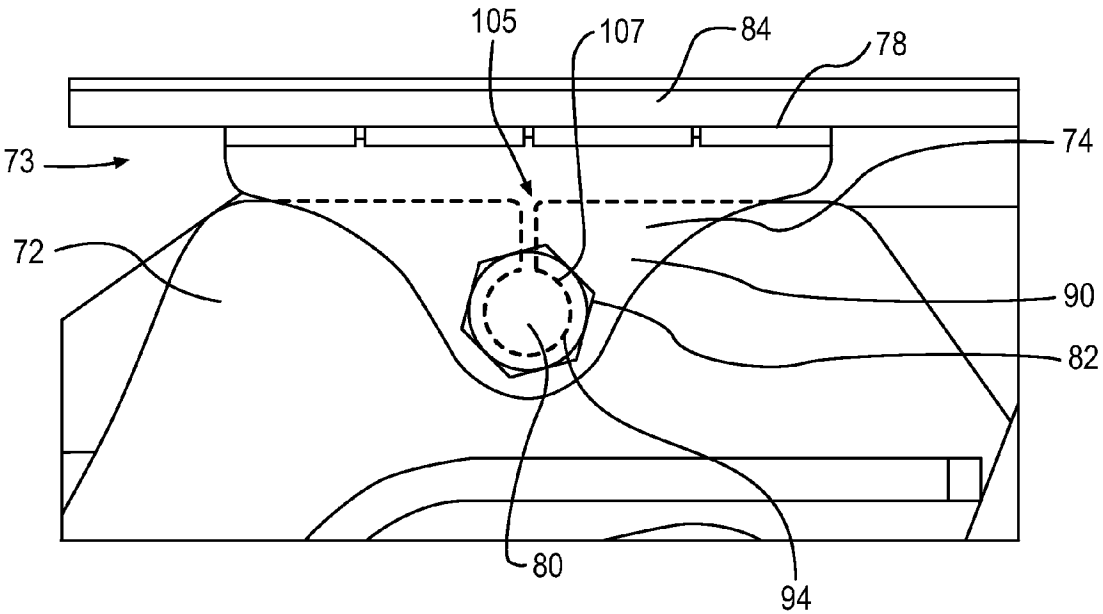
FIG. 11 is a side view of a stop system.

FIG. 11 is a partial side view of the stop system 73 according to the disclosure. The stop system 73 illustrates a stop shoe 74 having a body 90 where the hole 94 has no opening 95. The outline of the hole 94 shown in broken line. The rib 72 also has part of the outer contour which is obscured by the presence of the stop shoe 74 shown in broken line. The bolts 80 extend through the hole 107 to attach the stop shoe 74 to the rib 72. The bolts 80 are not tightened so much as to prevent the stop shoe 74 from being able to pivot with respect to the rib 72. The rib 72 may also have an opening 105 at the location of the hole 107 in the rib 72.

The tread plate 78 is shown butted up against the pressure plate 84. If the pressure plate 84 is not level with respect to the stop shoe 74, the initial contact between the stop shoe 74 and the pressure plate 84 can cause the stop shoe 74 to pivot about the bolt 80 in order to have the tread plate 78 lay flat against the pressure plate 84 as the pressure plate 84 and stop shoe 74 move closer together.

Figure 12:
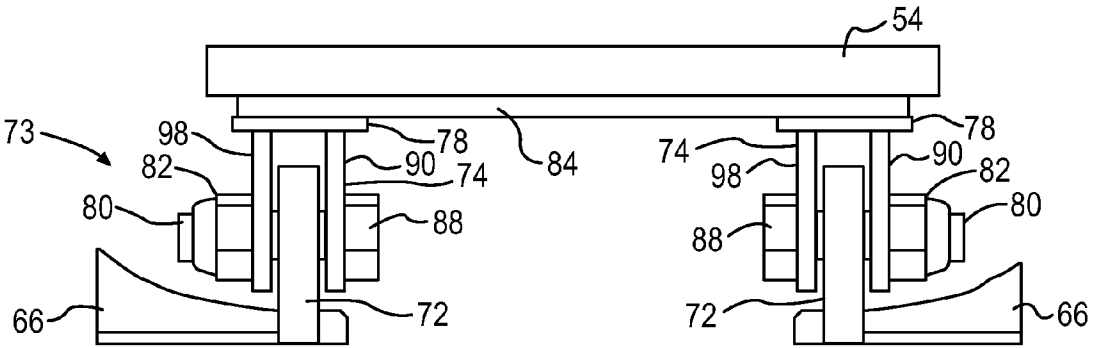
FIG. 12 is an end view of a stop system.

FIG. 12 is a partial end view of the stop system 73. Two ribs 72 extend up from the thumb 66 and have a bolt 80 attaching the stop shoe 74 to the rib 72. The bolt head 88 is pressed against the body 90 or 98 while the lock nut 82 is attached to the bolt 80 and is also pressed against the body either 90 or 98.

The tread plate 78 is pressed against the pressure plate 84 on the stick 54 as can be seen in FIG. 12. It may be desirable to have the height of the two tread plates 78 to be the same so that the pressure plate 84 is contacted at the same time by the two tread plates 78. Otherwise, if the height of the tread plates 78 were different, one of the stop shoes 74 will be contacted before the other stop shoe 74 which could place uneven forces on the pressure plate 84, stick 54 and thumb 66.

In some embodiments there is no pressure plate. In such embodiments, the stop shoe 74 may directly contact the stick 54 however the same basic principles described herein will apply.

When the thumb 66 opens to its extreme position causing the stop shoe 74 to impact the stick 54 via the pressure plate 84, the stop shoes 74 may not only rotate about the bolt 80 they may also slide a little bit along the pressure plate 84. The sliding motion may be caused by the difference in diameters of the bolt 80 and the holes 94 in the stop shoe 74 and the holes 107 in the rib 72. Furthermore, the openings 95 in the holes 94 in the stop shoe 74 and opening or hole 107 in the hole 107 in the rib 72 may facilitate minor deflections in the material forming the rib 72 and or stop shoe 74 when the stop shoe 74 or rib 72 are under stress. These deflections may also cause the sliding action of the tread plate 78 or surface along the pressure plate 84 and or stick 54. In some embodiments the sliding motion may be desired in that it along with a pivoting of the stop shoe 74 helps with aligning the tread plate 78 with the pressure plate 84 or stick 54 in a manner that reduces the likelihood of gouging the pressure plate 84 or stick 54 (in instances where a pressure plate 84 is absent). The sliding motion of the stop shoes 74 may also be caused, in part, by deflection of the thumb 66 and tolerances in the joint 62.

In some embodiments the size and strength of the bolts 80 may be selected so that if the thumb 66 is opened quickly, or otherwise provides a hard strike to the pressure plate 84 and or stick 54, the bolts 80 will shear before the stop shoes 74 dent, gouge, or damage the pressure plate 84 or stick 54. This shearing feature allows the bolts 80 to act as a mechanical fuse.

Figure 13:
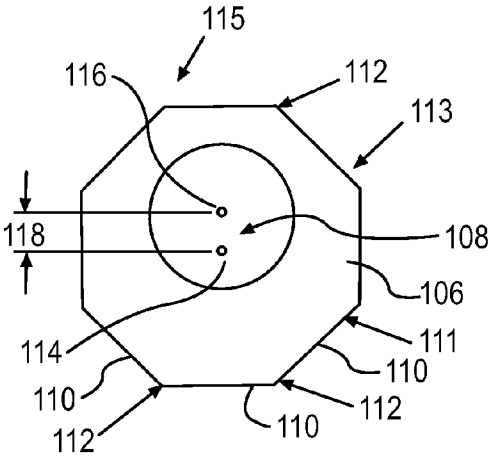
FIG. 13 is a side view of the slug used as part of an adjusting system.

An adjusting system 115 for the stop system 73 will now be described. FIG. 13 is a side view of a slug 106 having an eccentric hole 108. The slug 106 has flats 110 which help define an outer circumference 111 of the slug 106. The intersection of two flats 110 form a corner 112 on the outer circumference 111 of the slug 106. The flats 110 and corners 112 comprise part of the locking structure 113 on the outer circumference 111 of the slug 106. The slug 106, together with the locking structure 113, provides part of an adjusting system 115 for a stop system 73 (see FIG. 11).

The slug 106 has a center 114. The eccentric hole 108 has a center 116 that is significantly offset 118 from the center 114 of the slug 106. By rotating the slug 106 about its center 114, the height of the eccentric hole 108 will vary. As result, in instances where a slug 106 having an eccentric hole 108 is used as part of the adjusting system 115, adjustments in height can be made by rotating the slug 106.

Figure 14:
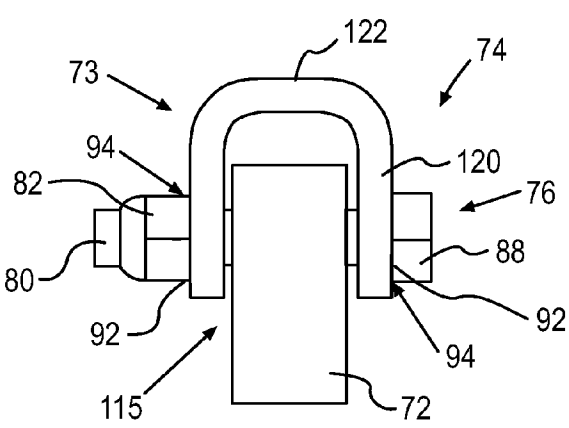
FIG. 14 is a partial end view of a stop and adjusting system.

FIG. 14 is an end view of a stop system 73 having a stop shoe 74 and an adjusting system 115 for adjusting the height of the stop shoe 74 with respect to the rib 72. The stop system 73 shown in FIGS. 14-16 has a different stop shoe 74 than shown in the previous figures. For example, the stop shoe 74 includes a body 120 that is made of a single piece of folded metal. The body 120 has a tread surface 122 rather than a separate tread plate 78 as described above. The portion of the body 120 defining the tread surface 122 may be referred to as a base plate. Optionally, a separate tread plate 78 could be attached to the body 120. In some instances the body 120 may be made of steel. The body 120 still has a boss 92 and a hole 94 similar to those features described above.

A fastener 76 (which may include a bolt 80 and lock nut 82) attaches the stop shoe 74 to the rib 72 in a manner similar to that described above. A bolt 80 extends through the hole 94 securing the body 120 between a lock nut 82 and the bolt head 88.

Figure 16:
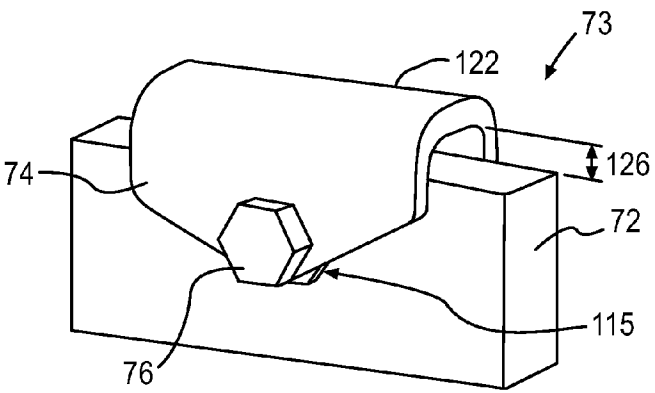
FIG. 16 is a partial isometric view of a stop and adjusting system.
Figure 15:
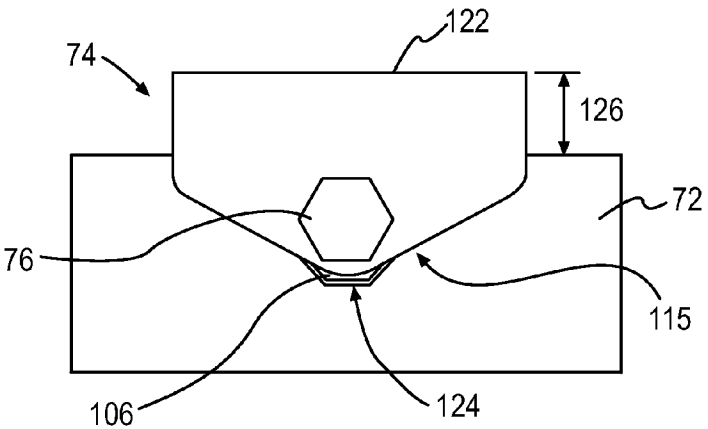
FIG. 15 is a partial side view of a stop and adjusting system.

FIGS. 15 and 16 are side and isometric views respectively of a stop system 73 including an adjusting system 115. The stop system 73 and the adjusting system 115 include a slug 106 fit into a hole 124 in the rib 72. The hole 124 has a corresponding shape to the slug 106 so that when the slug 106 is fit into the hole 124, the slug 106 is unable to rotate within the hole 124. A fastener 76 connects the stop shoe 74 to the slug 106 and in turn connects the stop shoe 74 to the rib 72. The fastener 76 extends through the eccentric hole 108 as illustrated in FIGS. 15 and 16, There is an offset 126 between the tread surface 122 and the rib 72. This offset 126 can be adjusted by removing the fastener 76 the stop shoe 74 and the slug 106. Once outside the hole 124, the slug 106 can be rotated to place the eccentric hole 108 into a desired position with respect to the rib 72. Then the slug 106 is placed into the hole 124 where it is rotationally locked in place. The stop shoe 74 is then attached to the slug 106 via the fastener 76. The offset 126 can also be affected by pivoting the stop shoe 74 about the fastener 76.

Figure 18:
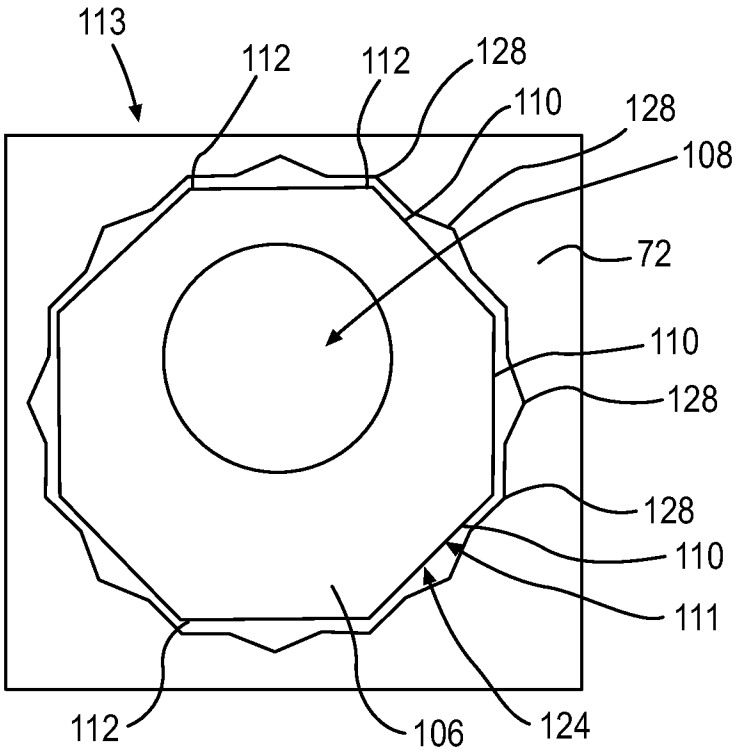
FIG. 18 is a partial side view of another adjusting system showing a slug fit into a corresponding hole.
Figure 17:
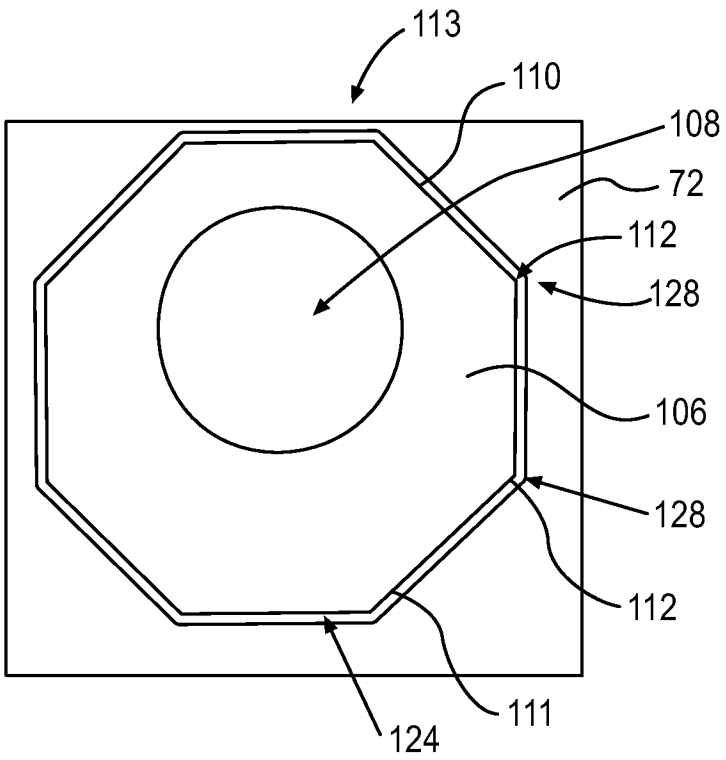
FIG. 17 is a partial side view of an adjusting system showing a slug fit into a corresponding hole.
Figure 19:
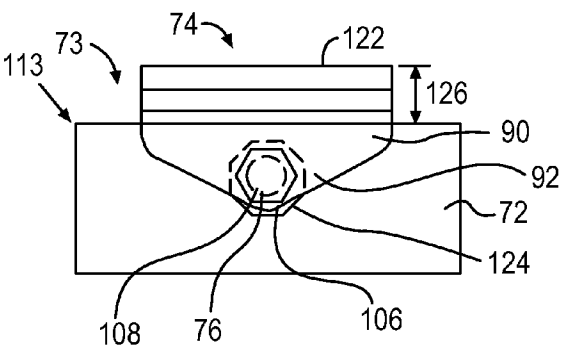
FIGS. 19-23 are partial side views of a stop and adjusting system where the adjusting system has been adjusted to place the stop shoe at various heights.
Figure 20:
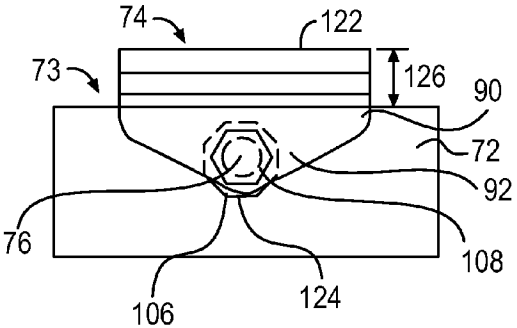
Figure 21:
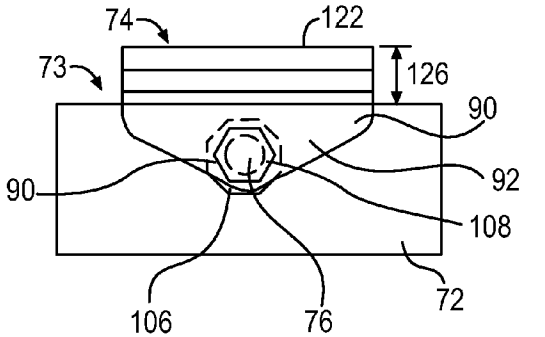
Figure 22:
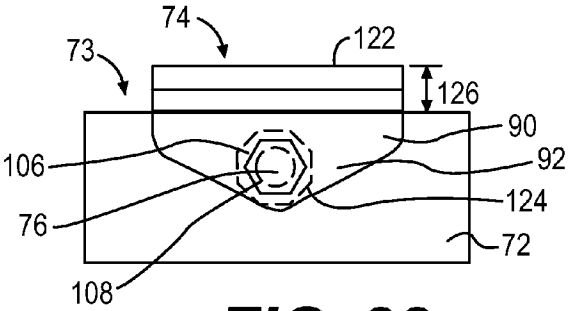
Figure 23:
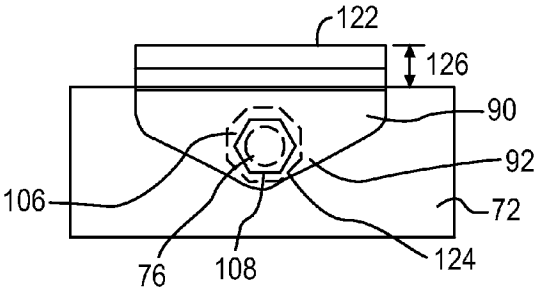

FIGS. 17 and 18 are partial side views of locking structure 113 that includes the slug 106 fit into a corresponding hole 124 in a rib 72. The slug 106 shown in FIGS. 17-18 has an eccentric hole 108. The eccentric hole 108 is in its highest position. As one of ordinary skill the art can appreciate, if the slug 106 was removed from the hole 124 and rotated to a different angular orientation, the eccentric hole 108 would be lowered. When the slug 106 is fit into the corresponding hole 124 the flats 110 of the outer circumference 111 of the slug 106 intersect to form corners 112. The corners 112 of the slug 106 are aligned with corners 128 in the corresponding hole 124 of the rib 72. In this manner, the slug 106 is locked from rotating within the hole 124 about the center axis by the locking structure 113 which includes the flats 110, corners 112, and corners 128 in the corresponding hole 124. In FIG. 17 there are the same amount of corners 128 in the corresponding hole 124 as corners 112 in the slug 106.

FIG. 18 illustrates a different version of a locking structure 113 than that shown in FIG. 17. FIG. 18 includes a slug 106 having an eccentric hole 108 where the intersection of two flats 110 form corners 112. However the corresponding hole 124 in the rib 72 has more corners 128 than corners 112 found on the outer circumference 111 of the slug 106. One reason for having additional corners 128 is it allows the locking structure 113 to secure the slug 106 in more positions than the locking structure 113 shown in FIG. 17. As such, the slug 106 can be rotated in more positions thereby allowing finer adjustments in height to be made than the locking structure 113 in FIG. 17.

One of ordinary skill the art will understand after reviewing this disclosure that the more corners 128 in the corresponding hole 124 the more height adjustments can be made to the eccentric hole 108 without actually increasing the extreme range between the highest and lowest positions of the eccentric hole 108. The locking structure 113 shown in FIG. 18 illustrates twice as many corners 128 in the hole 124 in the rib 72 than corners 112 on the outer circumference 111 of the slug 106. However in other embodiments, a fewer or greater number of corners 128 may be used in that shown in FIG. 18.

FIGS. 19 through 23 illustrate stop systems 73 and locking structure 113 where the locking structure 113 has been adjusted to allow the tread surface 122 to be at different offsets 126 with respect to the rib 72. The fastener 76 extends into the eccentric hole 108 attaching the body 90 at various heights with respect to the rib 72. The slug 106 is placed in a corresponding hole 124 to lock the slug 106 in an angular position to thereby secure the body 90 and tread surface 122 at a particular offset 126 with respect to the rib 72.

Where locking structures 113 are used similar to that shown in FIG. 17 the body 90 and tread surface 122 can have 5 different and unique positions or offsets 126 with respect to the rib 72. By removing the fastener 76 and the body 90, the slug 106 can be moved axially out of the corresponding hole 124 and rotated to allow the eccentric hole 108 to be moved to 5 different and unique positions. The body 90 can then be replaced and the fastener 76 reinstalled at each or any of these positions thereby allowing the tread surface 122 to be located at various heights or offsets 126 with respect to the rib 72. Five different unique positions are illustrated in FIGS. 19-23.

FIGS. 24-32 illustrate a stop system 73 having a different type of adjusting system 115. The adjusting system 115 shown in FIG. 24 includes a slug 106 located in a hole 124 in the rib 72. The slug 106 includes an eccentric hole 108 similar to the eccentric hole in the slug 106 in the adjustment system 115 described in the already mentioned and discussed figures. The slug 106 has an outer circumference 111 that is different than the outer circumference 111 discussed in the previous figures. The outer circumference 111 is basically circular with the exception of various voids 130 in the slug 106. The voids 130 are semicircular in cross-section as shown. Other voids 130 in similar systems that may fall within the scope of this disclosure may have different shaped voids 130.

The rib 72 also has a void 132 and when a void 130 in the slug 106 is aligned with the void 132 in the rib 72, a locking pin 134 may be placed to partially extend into the void 130 in the slug 106 and the void 132 in the rib 72 to thereby angularly lock the slug 106 with respect to the rib 72. One of ordinary skill in the art after viewing this disclosure will appreciate that the adjusting system 115 shown in FIG. 24 can be adjusted by rotating the slug 106 (when the locking pin 134 has been removed) to align various voids 130 with the void 132 in the rib 72 to cause the eccentric hole 108 to achieve a desired height with respect to the rib 72. Once the eccentric hole 108 is positioned to achieve the desired height, the void 130 in the slug 106 is aligned with the void 132 in the rib 72 and the locking pin 134 is placed in the voids 130, 132.

The voids 130 and locking pin 134 are not limited to the cross-sectional shapes of semicircle and circular as shown. Many different shapes may be used for the voids 130 and locking pin 134. For example, the cross-sectional shapes of the voids 130 and locking pin may include a square, rectangle, parallelogram, and a triangle. Other shapes may also be used.

Figure 25:
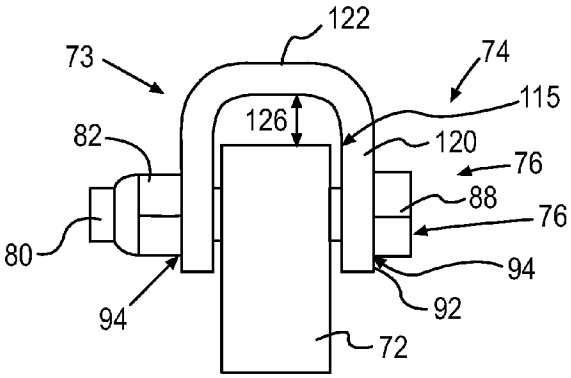
FIG. 25 is a partial end view of a stop and adjusting system.
Figure 27:
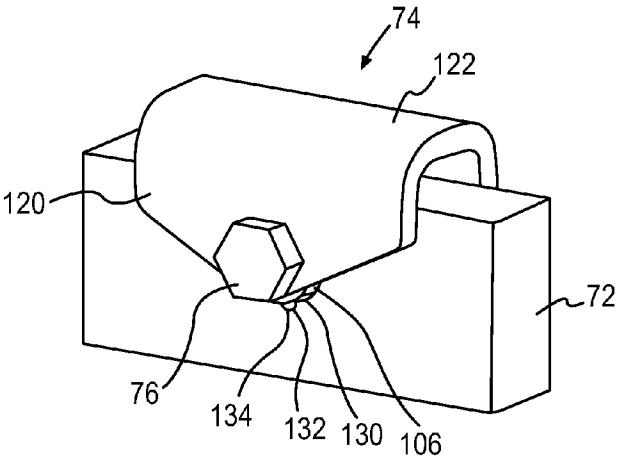
FIG. 27 is a isometric view of a stop and adjusting system.
Figure 24:
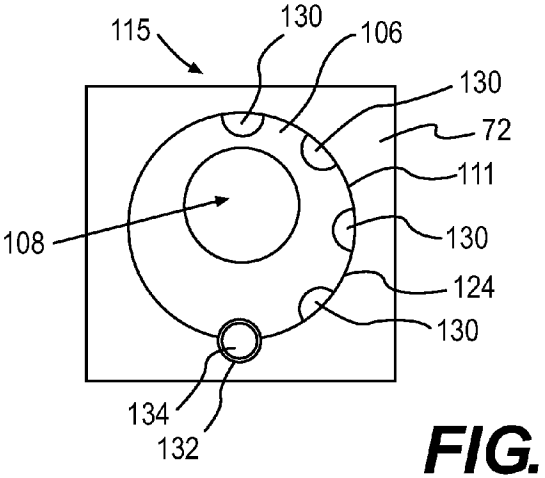
FIG. 24 is a partial side view of another adjusting system.
Figure 26:
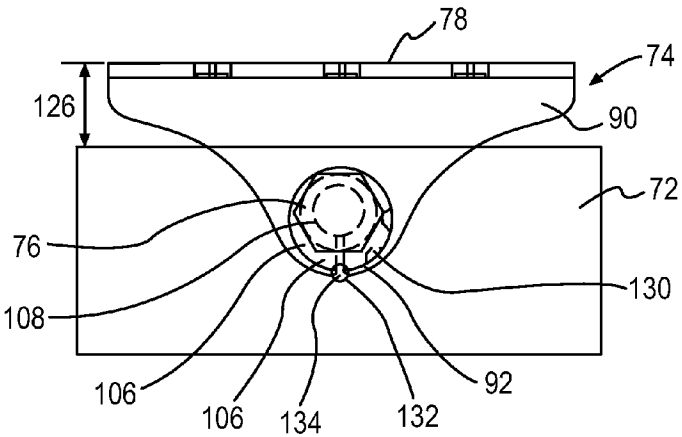
FIG. 26 is a side view of a stop and adjusting system.

FIGS. 25-27 illustrate additional components used in the stop system 73 and adjusting system 115 described in FIG. 24. The stop shoe 74 attaches to the rib 72 via the fastener 76 which includes the bolt head 88 the bolt 80 and lock nut 82. The bolt 80 extends through the hole 94 in the boss 92 of the stop shoe 74 thereby connecting the stop shoe 74 to the rib 72. The tread surface 122 and body 120 are offset by distance 126 above the rib 72.

FIG. 26 illustrates a stop shoe 74 having a similar construction as discussed above where the stop shoe 74 includes a body 90, a second body 98 (hidden from view in FIG. 26) where the bodies 90 and 98 are connected by a tread plate 78. A fastener 76 connects the stop shoe 74 to the rib 72. The tread plate 78 is raised above the rib 72 by offset 126. In the position shown in FIG. 26, the offset 126 is at its highest point because the eccentric hole 108 is also at its highest point. As discussed above, the offset 126 can be reduced by rotating the slug 106 in the manner described above. Even when the stop shoe 74 is at its highest position, the boss 92 covers the locking pin 134 keeping a locking pin 134 retained in the voids 130 and 132.

FIG. 27 is an isometric view where the stop shoe 74 is different than the stop shoe shown in FIG. 26. The stop shoe 74 of FIG. 27 is similar to the stop shoe shown in FIG. 25. The stop shoe 74 includes a tread surface 122 and a body 120. The fastener 76 connects the stop shoe 74 to the rib 72. The locking pin 134 is extending into the void 132 in the rib 72 and void 130 in the slug 106. One of ordinary skill the art will appreciate after reviewing this disclosure that the various adjusting systems 115 are not limited to specific types of stop shoe 74 and various stop shoes 74 can be mixed and matched with various adjusting systems 115.

Figure 28:
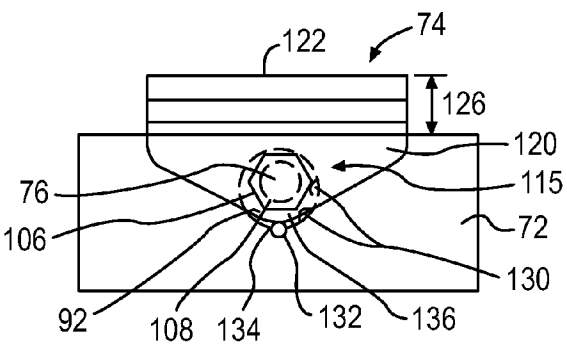
FIGS. 28-32 are partial side views of a stop and adjusting system where the adjusting system has been adjusted to place the stop shoe at various heights.
Figure 31:
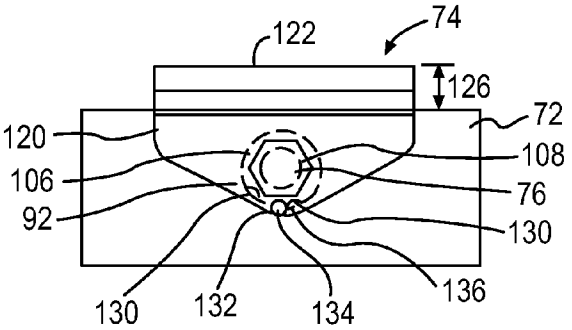
Figure 29:
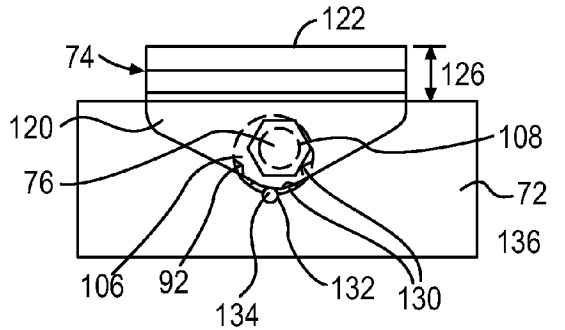
Figure 32:
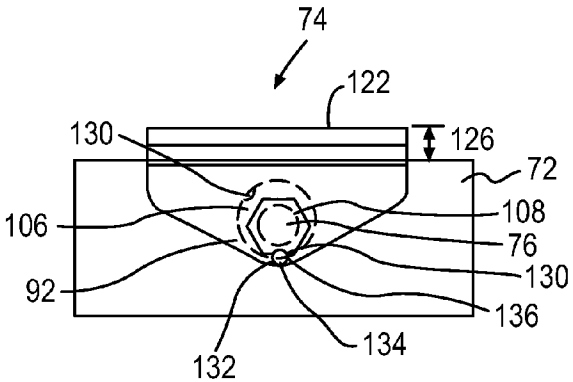
Figure 30:
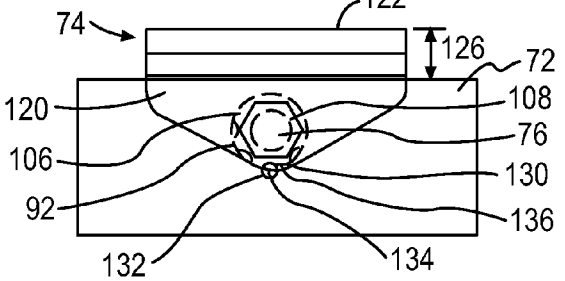

FIGS. 28 through 32 illustrate different heights the stop shoe 74 can have with respect to the rib 72 or in other words different heights of the offset 126 when the adjusting system 115 is set to various levels. Certain features that should be hidden by the boss 92 or the body 120 are shown in broken lines in order to illustrate these features. The stop shoe 74 includes a body 120 having a tread surface 122. The fastener 76 is located in the eccentric hole 108 in the slug 106. In FIG. 28 the eccentric hole 108 it is at its highest position therefore causing the tread surface 122 also be at its highest position with respect to the rib 72. FIGS. 29 through 32 illustrate the adjusting system 115 at heights below the highest level shown FIG. 28.

The voids 130 in the slug 106 and the void 132 in the rib 72 can be seen in FIGS. 28-32. The locking pin 134 is illustrated and shown to be located in one of the voids 130 in the slug 106 and the void 132 in the rib. The tip 136 of the boss 92 overhangs the locking pin 134 in order to axially retain the locking pin 134 in place. The overhang retaining feature of the tip 136 of the boss 92 may occur when the stop shoe 74 is in all positions including the highest position as shown in FIG. 28 and when the stop shoe 74 is pivoted to the extreme position in either rotational direction.

Figure 33:
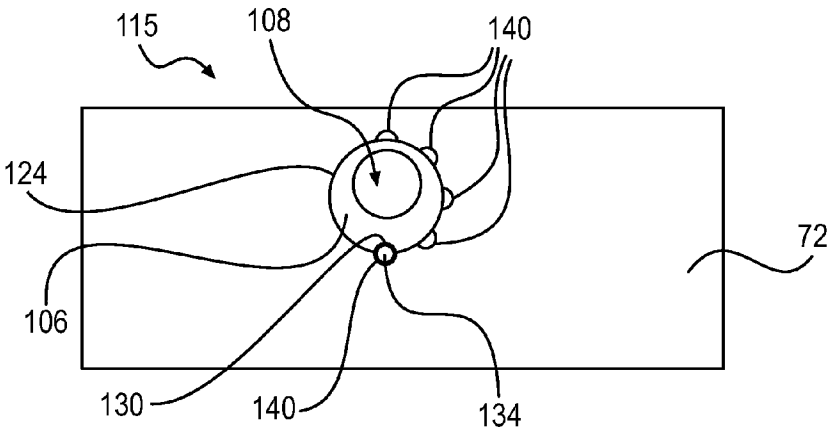
FIG. 33 is a partial side view of another adjusting system.
Figure 34:
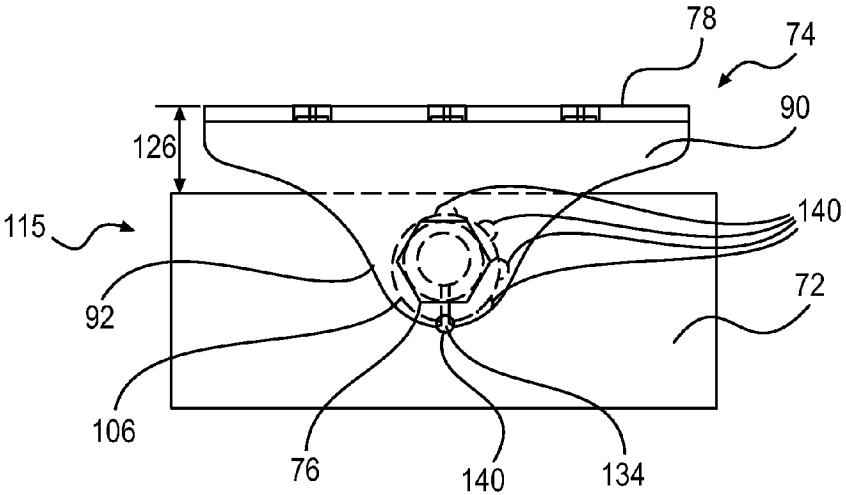
FIG. 34 is a side view of a stop and adjusting system.

FIGS. 33-34 illustrate an alternate adjusting system 115. The adjusting system 115 shown in FIG. 33 includes a slug 106 located in a hole 124 in the rib 72. The slug 106 includes an eccentric hole 108 similar to the eccentric hole in the slug 106 in the adjustment system 115 described in the already mentioned and discussed figures. The hole 124 is basically circular with the exception of various voids 140. The voids 140 are semicircular in cross-section as shown. Other voids 140 in similar systems that may fall within the scope of this disclosure may have different shaped voids 140.

When the void 130 in the slug 106 is aligned with the a void 140 in the rib 72 (or hole 124), a locking pin 134 may be placed to partially extend into the void 130 in the slug 106 and the void 140 in the rib 72 to thereby angularly lock the slug 106 with respect to the rib 72. One of ordinary skill in the art after viewing this disclosure will appreciate that the adjusting system 115 shown in FIG. 33 can be adjusted by rotating the slug 106 (when the locking pin 134 has been removed) to align various voids 140 with the void 130 in the slug 106 to cause the eccentric hole 108 to achieve a desired height with respect to the rib 72. Once the eccentric hole 108 is positioned to achieve the desired height, the void 130 in the slug 106 is aligned with the void 140 in the rib 72 and the locking pin 134 is placed in the voids 130, 140.

The voids 130, 140 and locking pin 134 are not limited to the cross-sectional shapes of semicircle and circular as shown. Many different shapes may be used for the voids 130, 140 and locking pin 134. For example, the cross-sectional shapes of the voids 130, 140 and locking pin may include a square, rectangle, parallelogram, and a triangle. Other shapes may also be used.

FIG. 34 illustrates a stop shoe 74 having a similar construction as discussed above where the stop shoe 74 includes a body 90, a second body 98 (hidden from view in FIG. 74) where the bodies 90 and 98 are connected by a tread plate 78. A fastener 76 connects the stop shoe 74 to the rib 72. The tread plate 78 is raised above the rib 72 by offset 126. In the position shown in FIG. 34, the offset 126 is at its highest point because the eccentric hole 108 is also at its highest point. As discussed above, the offset 126 can be reduced by rotating the slug 106 in the manner described above. Even when the stop shoe 74 is at its highest position, the boss 92 covers the locking pin 134 keeping a locking pin 134 retained in the voids 130 and 132. Multiple voids 140 can allow tread plate 78 to achieve many positions with respect to the rib 72 similar to the many positions shown, for example in FIGS. 28-32.

In some instances when it is desired to have one of the stop shoes 74 at a height between levels permitted by the adjusting system 115 the stop shoe 74 may easily be removed and ground or have material added to achieve the desired level.

Many features and advantages of apparatus and methods described in the current disclosure are apparent from this disclosure, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

INDUSTRIAL APPLICABILITY

As can be appreciated the disclosure herein contains several industrial applications. For example, the apparatus and method disclosed herein can provide a function of protecting a stick 54 from damage by a thumb 66 striking the stick when the thumb 66 is moved to an open position. Protection of the stick 54 allows the stick 54 to provide long and reliable service. The adjusting system 115 allows for the adjustment of a pair of stop shoes 74 to be adjusted so that they obtain a height that allows the stop shoes 74 to both contact either the stick 54 or a pressure plate 84 on the stick 54 at the same time. Having the stop shoe 74 contact or butt against the stick 54 or pressure plate 84 at the same time helps to avoid placing too much stress on one or the other stop shoe 74 or one or the other side of a stick 54 or pressure plate 84. The system described herein may also reduce the likelihood of the stick 54 from being gouged or otherwise damaged by the thumb 66.

Furthermore the apparatus described herein allows for an adjusting system 115 and the stop system 73 to be installed at the factory rather than relying on a dealer or operator to install stop systems. By allowing the manufacturer to install the stop system 73 and or adjusting system 115 additional quality control may be assured, and manufacturing burdens may be relieved from dealers and/or operators.

Some systems and methods described herein may provide an advantage in that the stop system may not use a significant projection on the stick 54. Omitting projections on the stick 54 may make digging specifically shaped holes such as trenches easier for operators in than an operator does not need to worry about a projection on the stick 54 contacting or interfering with the edges of the hole or trench. Furthermore, welding a projection onto the stick 54 may change the structural stiffness of the stick 54 in a negative manner. This disclosure may be an improvement over the prior art which occasionally requires operators to mind the projection on the stick when digging and may use a stick with a compromised structural stiffness.

What is claimed is:

1. A stop system for a machine having a thumb and stick comprising;

a first member being either the thumb or stick;

a second member being the other of the thumb or stick than the first member, the second member movable with respect to the first member, the first and second members being different parts of a common machine;

a first body including a first boss defining a first hole;

a base plate defining a substantially flat surface, the base plate being at least one of: attached to and part of, the first body on a side of the first body opposite of the first boss, the first body and the base plate forming a first shoe; and a fastener extending through the first hole in the first boss thereby pivotally attaching the first body to one of the first member and the second member wherein the fastener is dimensioned and made of a material selected to cause the fastener to shear before the base plate causes gouges in the member to which the first body is not attached when the base plate and the member to which the first body is not attached, come into hard contact; and a substantially flat contact surface located on the other of the first member and the second member than the first body, the substantially flat contact surface located such that when the first and second members are in proximity with each other, the base plate contacts the substantially flat contact surface.

2. The stop system of claim 1, further comprising:

a second boss located on a second body defining a second hole substantially coaxial with the first hole in the first boss; and wherein the base plate connects the first body and the second body and the fastener extends through the first hole in the first boss and the second hole and a hole in either of the first and second members.

3. The stop system of claim 2, further comprising a second shoe located proximal to the first shoe and the second shoe is located and configured to contact a contact surface.

4. The stop system of claim 2, wherein the first body and the second body are made of a single piece of folded metal.

5. The stop system of claim 1, wherein the first body pivots about the fastener with respect to the member to which the first body is attached.

6. The stop system of claim 1, wherein the base plate is attached to the first body.

7. The stop system of claim 6, wherein the base plate defines at least one hole and the first body defines at least one protrusion, wherein the at least one hole and the at least one protrusion are dimensioned to allow the protrusion to extend at least partially in the hole, wherein the protrusion is spot welded to the base plate in the at least one hole in the base plate.

8. The stop system of claim 1, wherein the substantially flat contact surface is an outer surface of either the first or second member.

9. The stop system of claim 1, wherein the substantially flat contact surface is on a plate attached to a member other than the member to which the first body is attached.

10. The stop system of claim 1, wherein the first member is a thumb and the second member is a stick.

11. The stop system of claim 1, further comprising a hole in one of the members through which the fastener extends along with the first hole in the first boss and the hole in one of the members and the first hole in the first boss are slightly differently sized from each other thereby configuring the base plate to both pivot and slide when the base plate contacts the member to which the first body is not attached.

12. The stop system of claim 1, wherein the fastener is a shear pin having material and dimensions selected to cause the shear pin to shear before the base plate causes gouges in the member to which the first body is not attached when the base plate and the member to which the first body is not attached, come into hard contact.

13. A stop system for a machine having a thumb and stick comprising;

a first member being either the thumb or stick;

a second member being the other of the thumb or stick than the first member, the second member movable with respect to the first member, the first and second members being different parts of a common machine;

a pivoting means for abutting defining a substantially flat abutting surface, the pivoting means attached to one of the first member and the second member; and a contact surface being substantially flat and located on a member other than the one of the first and second members attached to the pivoting means for abutting, the contact surface located such that when the first and second members are in contact with each other, the pivoting means for abutting contacts the contact surface, wherein the pivoting means for abutting is attached via a fastener made of a material and dimensioned to cause the fastener to shear before the abutting surface causes gouges in the contact surface when the abutting surface and the contact surface come into hard contact.

* * * * *